US010612782B2

(12) United States Patent
Toon et al.

(10) Patent No.: US 10,612,782 B2
(45) Date of Patent: Apr. 7, 2020

(54) FUEL SPRAY NOZZLE HAVING A SPLITTER WITH BY-PASS DUCTS

(71) Applicant: ROLLS-ROYCE PLC, London (GB)

(72) Inventors: Ian James Toon, Leicester (GB); Robert Anthony Hicks, Derby (GB)

(73) Assignee: ROLLS-ROYCE plc, London (GB)

( * ) Notice: Subject to any disclaimer, the term of this patent is extended or adjusted under 35 U.S.C. 154(b) by 211 days.

(21) Appl. No.: 15/878,518

(22) Filed: Jan. 24, 2018

(65) Prior Publication Data

US 2018/0149362 A1 May 31, 2018

Related U.S. Application Data

(63) Continuation of application No. 14/553,451, filed on Nov. 25, 2014, now Pat. No. 9,915,429.

(30) Foreign Application Priority Data

Dec. 10, 2013 (GB) ..... 1321764.1

(51) Int. Cl.
*F23R 3/28* (2006.01)
*F23R 3/14* (2006.01)
(Continued)

(52) U.S. Cl.
CPC ..... *F23R 3/283* (2013.01); *F23D 11/107* (2013.01); *F23R 3/14* (2013.01); *F23R 3/28* (2013.01);
(Continued)

(58) Field of Classification Search
CPC .. F23R 3/283; F23R 3/28; F23R 3/343; F23R 3/286; F23R 3/14; F23R 2900/03343; F23D 11/107
See application file for complete search history.

(56) References Cited

U.S. PATENT DOCUMENTS 5,737,921 A 4/1998 Jones et al.
6,272,840 B1 * 8/2001 Crocker ..... F02C 7/22 239/404
(Continued)

FOREIGN PATENT DOCUMENTS

GB 2473722 A 3/2011
WO 2009/126485 A2 10/2009

OTHER PUBLICATIONS

Jun. 27, 2014 Search Report issued in United Kingdom Application No. 1321764.1.
(Continued)

*Primary Examiner* — Carlos A Rivera
(74) *Attorney, Agent, or Firm* — Oliff PLC

(57) ABSTRACT

Nozzle for engine has coaxial arrangement of inner pilot and outer mains airblast fuel injectors and intermediate air-swirler passage sandwiched between the outer and inner air-swirler passages of the pilot and mains airblast fuel injectors, respectively. The nozzle has an annular first-splitter wall separating the pilot outer air-swirler passage from the intermediate one. An outer surface profile of the first-splitter wall defines radially inner side of the intermediate air-swirler passage. The nozzle has an annular second-splitter wall separating the intermediate air-swirler passage from mains inner air-swirler passage. An inner surface profile of second-splitter wall defines radially outer side of intermediate air-swirler passage. The outer and inner surface profile of the first and second splitters walls, respectively, have convergent sections facing each other forming convergent portion of the intermediate air-swirler passage. The inner surface profile of the second-splitter wall has a divergent section downstream of its convergent section.

11 Claims, 5 Drawing Sheets

(51) Int. Cl.
*F23R 3/34* (2006.01)
*F23D 11/10* (2006.01)

(52) U.S. Cl.
CPC ..... *F23R 3/286* (2013.01); *F23R 3/343* (2013.01); *F23R 2900/03343* (2013.01)

(56) References Cited

U.S. PATENT DOCUMENTS

| | | | | |
|---|---|---|---|---|
| 6,986,255 | B2 * | 1/2006 | Smith | F23R 3/14 60/737 |
| 7,779,636 | B2 * | 8/2010 | Buelow | F23R 3/14 60/742 |
| 2003/0196440 | A1 | 10/2003 | Steinthorsson et al. | |
| 2009/0173076 | A1 * | 7/2009 | Toon | F23D 14/74 60/746 |
| 2010/0050644 | A1 * | 3/2010 | Pidcock | F23D 11/107 60/737 |
| 2010/0263382 | A1 * | 10/2010 | Mancini | F23R 3/14 60/742 |
| 2010/0287946 | A1 * | 11/2010 | Buelow | F23R 3/14 60/776 |
| 2011/0000219 | A1 * | 1/2011 | Myers, Jr. | F02C 9/28 60/776 |
| 2011/0067403 | A1 * | 3/2011 | Williams | F23R 3/343 60/742 |
| 2012/0151929 | A1 * | 6/2012 | Patel | F23R 3/28 60/740 |

OTHER PUBLICATIONS

Aug. 8, 2017 Office Action issued in U.S. Appl. No. 14/553,451.
Dec. 13, 2017 Notice of Allowance issued in U.S. Appl. No. 14/553,451.

* cited by examiner

FUEL SPRAY NOZZLE HAVING A SPLITTER WITH BY-PASS DUCTS

CROSS REFERENCE TO RELATED APPLICATION

This application is a continuation application of U.S. application Ser. No. 14/553,451, filed Nov. 25, 2014, the contents of which are incorporated herein by reference

FIELD OF THE INVENTION

The present invention relates to a fuel spray nozzle for combustors of gas turbine engines.

BACKGROUND OF THE INVENTION

Fuel injection systems deliver fuel to the combustion chamber of a gas turbine engine, where the fuel is mixed with air before combustion. One form of fuel injection system well-known in the art utilises fuel spray nozzles. These atomise the fuel to ensure its rapid evaporation and burning when mixed with air.

An airblast atomiser nozzle is a type of fuel spray nozzle in which fuel delivered to the combustion chamber by one or more fuel injectors is aerated by air swirlers to ensure rapid mixing of fuel and air, and to create a finely atomised fuel spray. The swirlers impart a swirling motion to the air passing therethrough, so as to create a high level of shear and hence acceleration of the low velocity fuel film.

Typically, an airblast atomiser nozzle has a number of coaxial air swirler passages. An annular fuel passage between a pair of air swirler passages feeds fuel onto a prefilming lip, whereby a sheet of fuel develops on the lip. The sheet breaks down into ligaments which are then broken up into droplets within the shear layers of the surrounding highly swirling air to form the fuel spray stream that enters the combustor.

Hot combustion gases can produce high metal temperatures in the nozzle, leading to degradation of the nozzle and a reduced service life. In particular, in nozzles having a coaxial arrangement of an inner pilot airblast fuel injector, an intermediate air swirler passage and an outer mains airblast fuel injector, high metal temperatures can be problem for a wall of the intermediate air swirler passage.

It is desirable to provide a fuel spray nozzle that is less susceptible to high metal temperatures.

SUMMARY OF THE INVENTION

The swirling air passing through the air swirler passages can help to protect the nozzle from contact with hot combustion gases, and can also convectively cool surfaces of the nozzle, extracting heat absorbed from flame radiation.

Accordingly, in a first aspect, the present invention provides a fuel spray nozzle for a gas turbine engine, the nozzle having a coaxial arrangement of an inner pilot airblast fuel injector and an outer mains airblast fuel injector, the nozzle further having an intermediate air swirler passage which is sandwiched between an outer air swirler passage of the pilot airblast fuel injector and an inner swirler air passage of the mains airblast fuel injector, wherein:

the nozzle further has an annular first splitter wall which separates the pilot outer air swirler passage from the intermediate air swirler passage, an outer surface profile of the first splitter wall defining a radially inner side of the intermediate air swirler passage; and the nozzle further has an annular second splitter wall which separates the intermediate air swirler passage from the mains inner air swirler passage, an inner surface profile of the second splitter wall defining a radially outer side of the intermediate air swirler passage;

the outer surface profile of the first splitter wall and the inner surface profile of the second splitter wall having respective convergent sections (the convergence being relative to the overall axial direction of flow through the injector) which face each other to produce a convergent portion of the intermediate air swirler passage, and the inner surface profile of the second splitter wall further having a divergent section (similarly, the divergence being relative to the overall axial direction of flow through the injector) downstream of its convergent section.

Advantageously, the convergent section of the inner surface profile of the second splitter wall helps the air flow through the intermediate air swirler passage to form and maintain a cooling film on the convergent section of the outer surface profile of the first splitter wall. In this way, the metal temperature of the first splitter wall can be reduced, improving the service life of the nozzle.

In a second aspect, the present invention provides a combustor of a gas turbine engine having a plurality of fuel spray nozzles according to the first aspect.

In a third aspect, the present invention provides a gas turbine engine having the combustor of the second aspect.

Optional features of the invention will now be set out. These are applicable singly or in any combination with any aspect of the invention.

The pilot airblast fuel injector may typically have, in order from radially inner to outer, a coaxial arrangement of a pilot inner swirler air passage, a pilot fuel passage, and the pilot outer air swirler passage. The mains airblast fuel injector may typically have, in order from radially inner to outer, a coaxial arrangement of the mains inner swirler air passage, a mains fuel passage, and a mains outer air swirler passage. In either case, fuel exiting the respective fuel passage is atomised into a spray by surrounding swirling air exiting the air swirler passages.

The convergent section of the outer surface profile may extend downstream to a terminating annular lip of the first splitter wall.

The first splitter wall may be substantially frustoconical in shape over the length of the convergent section of its outer surface profile.

The divergent section of the inner surface profile may extend downstream to a terminating annular lip of the second splitter wall.

The second splitter wall may be substantially frustoconical in shape over the length of the divergent section of its inner surface profile.

The second splitter wall may have an inwardly directed annular nose which forms a transition between the convergent and divergent sections of the inner surface profile of the second splitter wall. The nose can act as a shroud, discouraging separation of the air flow leaving the convergent portion of the intermediate air swirler from the outer surface profile of the first splitter wall.

The intermediate air swirler passage typically contains a swirler that produces a swirl angle for the air flow through the intermediate air swirler passage. The swirler may produce a swirl angle for the air flow of more than 45° relative to the overall direction of flow through the passage. Preferably, the swirl angle may be more than 55° or 65°. By producing a relatively high swirl angle, swirling flow can be maintained around the successive convergent and divergent sections of the inner surface profile of the second splitter wall.

The second splitter wall may contain a row of circumferentially arranged internal bypass ducts which are arranged such that, in use, a portion of the air flow through the intermediate air swirler passage is diverted through the ducts to by-pass the convergent portion of the intermediate air swirler passage, the diverted air exiting the ducts to re-join the non-diverted air flow at the divergent section of the inner surface profile of the second splitter wall. In this way, if the non-diverted air flow is unable to form an adequate cooling film on the second splitter wall, e.g. over the most downstream end of the divergent section of its inner surface profile, the diverted air can be used to maintain cooling film coverage in such regions. In addition, air jets emerging from the ducts can provide impingement cooling of the second splitter wall.

The ducts may be angled at substantially the same angle as the swirl angle of the air flow through the intermediate air swirler passage. This assists the air flow to remain attached to the second splitter wall over the divergent section.

The second splitter wall may further contain an internal annular passage which is arranged such that an upstream end of the internal annular passage receives the diverted air flow exiting the ducts and a downstream end of the internal annular passage opens to the divergent section of the inner surface profile of the second splitter wall to re-join the diverted air flow with the non-diverted portion of the air flow. Such an internal passage allows the position at which the diverted air flow re-joins with the non-diverted air flow to be selected for best effect. For example, locating the downstream end of the internal annular passage close to the downstream end of the divergent section can help to reduce metal temperatures e.g. over exposed regions adjacent a terminating lip of the second splitter wall.

The first splitter wall may contain a row of circumferentially arranged effusion holes at the downstream end of the convergent portion of the intermediate air swirler passage. The holes can be angled at the swirl angle of the air flow through the intermediate air swirler passage. The holes can help to cool the first splitter wall, particularly in a region of the terminating lip of the wall.

BRIEF DESCRIPTION OF THE DRAWINGS

Embodiments of the invention will now be described by way of example with reference to the accompanying drawings in which.

DETAILED DESCRIPTION AND FURTHER OPTIONAL FEATURES OF THE INVENTION

Figure 1:
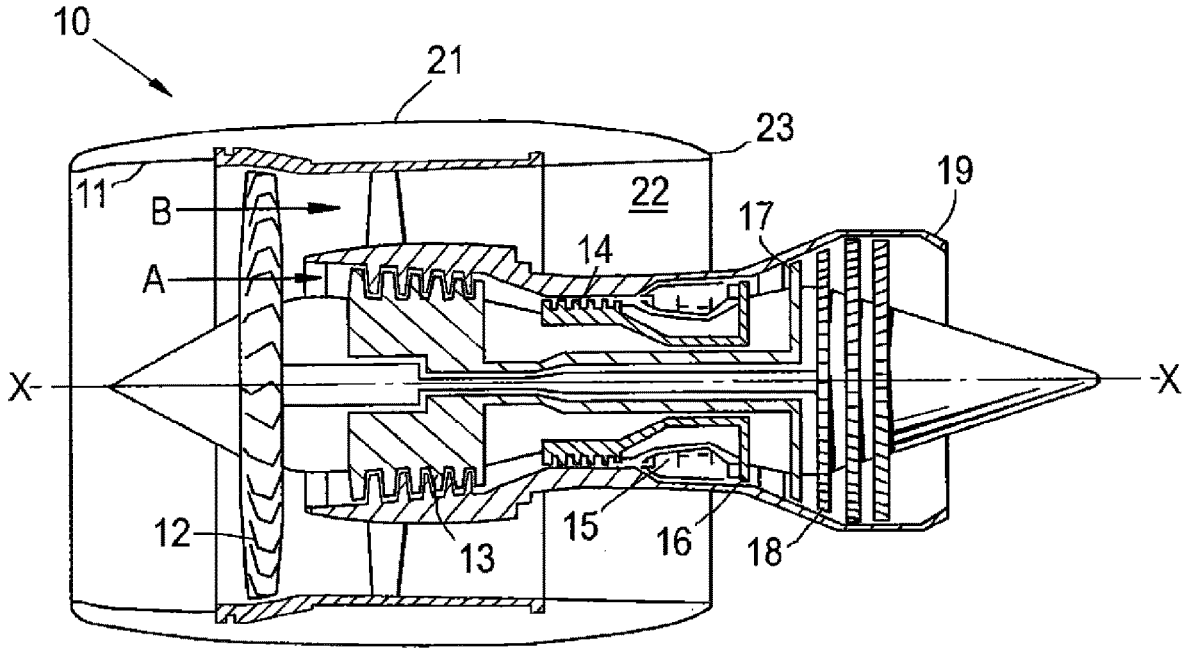
FIG. 1 shows a longitudinal cross-section through a ducted fan gas turbine engine.

With reference to FIG. 1, a ducted fan gas turbine engine incorporating the invention is generally indicated at 10 and has a principal and rotational axis X-X. The engine comprises, in axial flow series, an air intake 11, a propulsive fan 12, an intermediate pressure compressor 13, a high-pressure compressor 14, combustion equipment 15, a high-pressure turbine 16, an intermediate pressure turbine 17, a low-pressure turbine 18 and a core engine exhaust nozzle 19. A nacelle 21 generally surrounds the engine 10 and defines the intake 11, a bypass duct 22 and a bypass exhaust nozzle 23.

During operation, air entering the intake 11 is accelerated by the fan 12 to produce two air flows: a first air flow A into the intermediate pressure compressor 13 and a second air flow B which passes through the bypass duct 22 to provide propulsive thrust. The intermediate pressure compressor 13 compresses the air flow A directed into it before delivering that air to the high pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high, intermediate and low-pressure turbines respectively drive the high and intermediate pressure compressors 14, 13 and the fan 12 by suitable interconnecting shafts.

Figure 2:
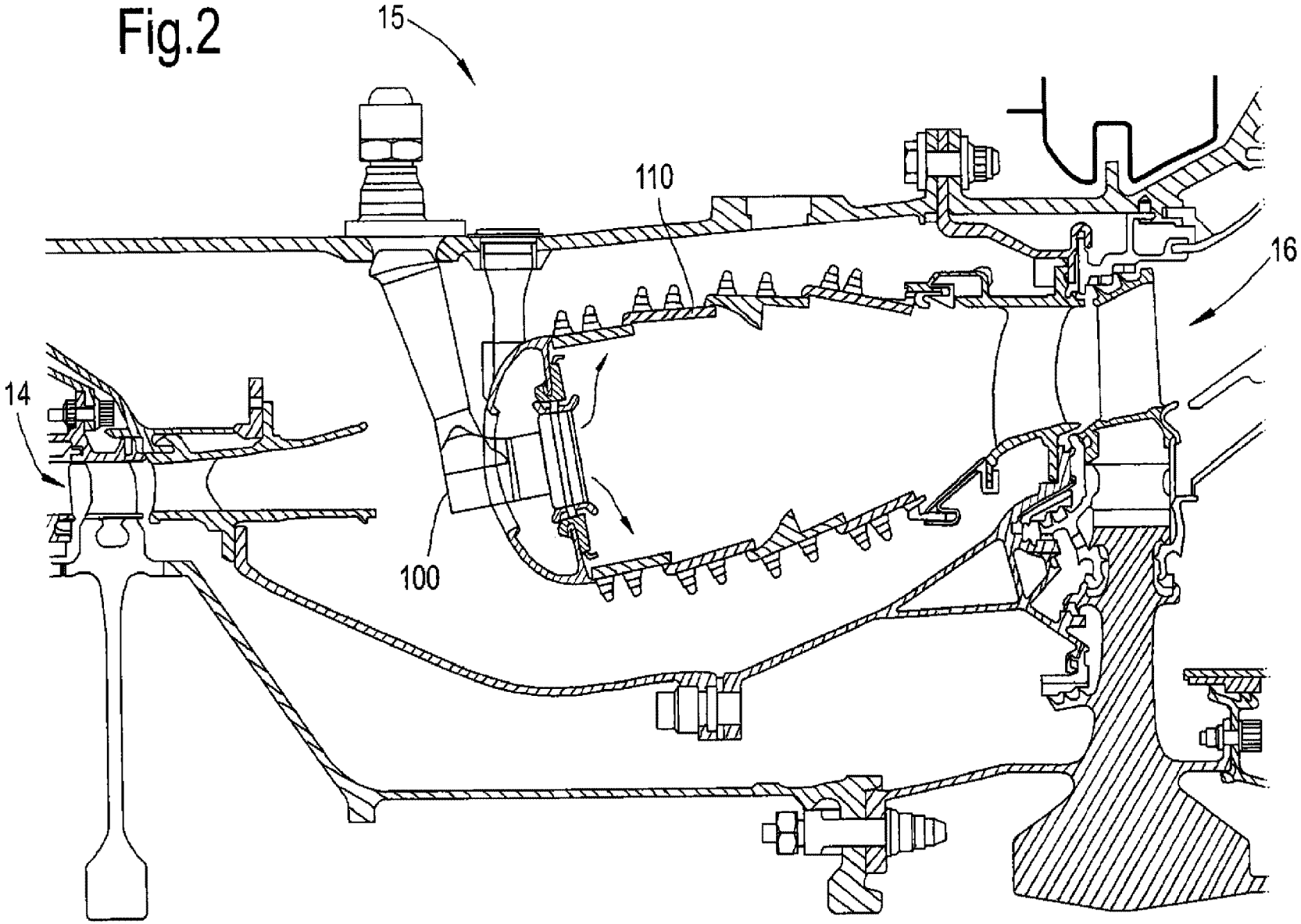
FIG. 2 shows a longitudinal cross-section through combustion equipment of the gas turbine engine of FIG. 1.

FIG. 2 shows a longitudinal cross-section through the combustion equipment 15 of the gas turbine engine 10 of FIG. 1. A row of lean burn fuel spray nozzles 100 spray the fuel into an annular combustor 110.

Figure 3:
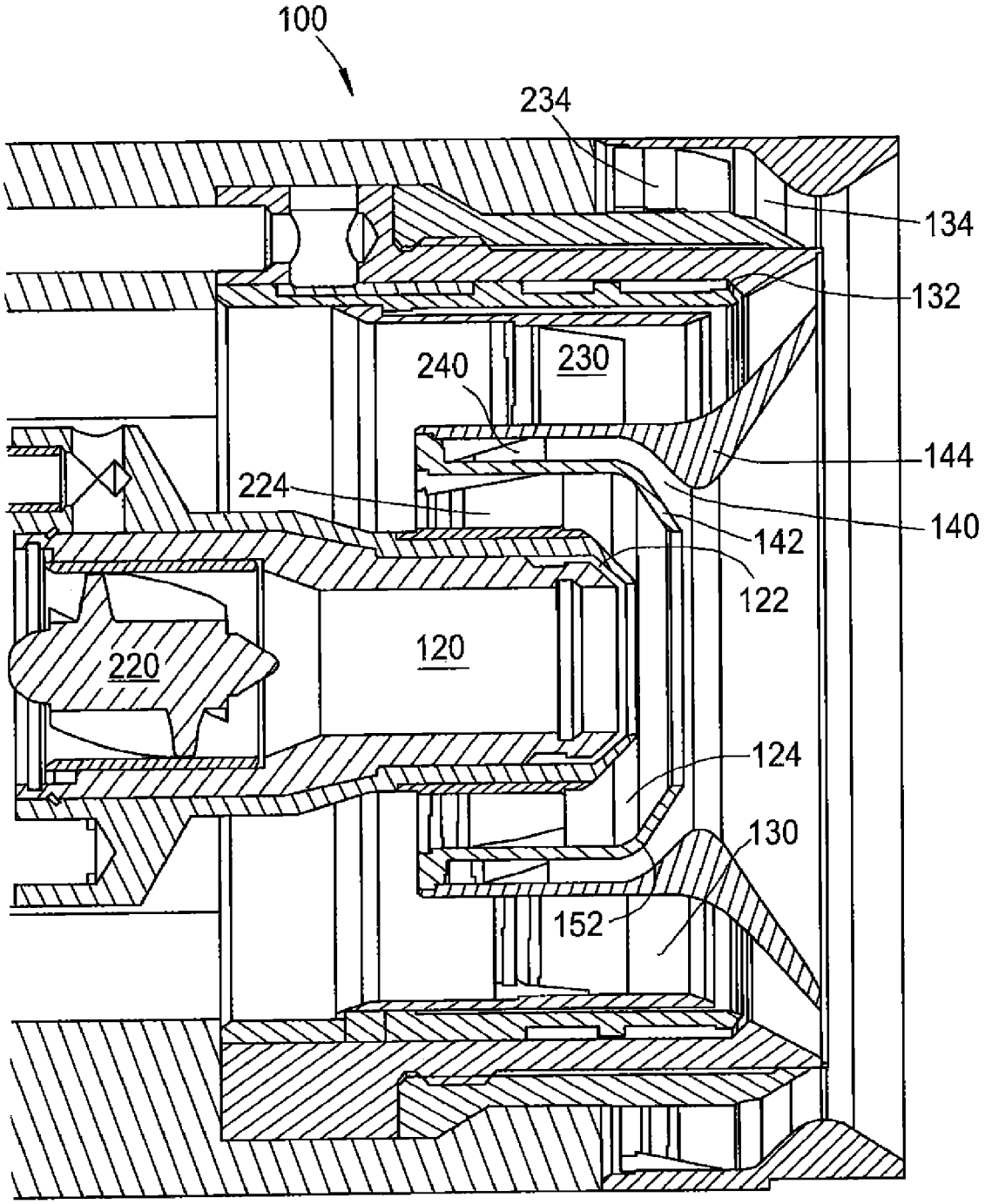
FIG. 3 shows a longitudinal cross-section through a fuel spray nozzle of the combustion equipment of FIG. 2.

FIG. 3 shows a longitudinal cross-section through one of the fuel spray nozzles 100. The nozzle has a coaxial arrangement of an inner pilot airblast fuel injector and an outer mains airblast fuel injector. The pilot airblast fuel injector has, in order from radially inner to outer, a coaxial arrangement of a pilot inner swirler air passage 120, a pilot fuel passage 122, and a pilot outer air swirler passage 124. The mains airblast fuel injector has, in order from radially inner to outer, a coaxial arrangement of a mains inner swirler air passage 130, a mains fuel passage 132, and a mains outer air swirler passage 134. An intermediate air swirler passage 140 is sandwiched between the outer air swirler passage 124 of the pilot airblast fuel injector and the inner swirler air passage 130 of the mains airblast fuel injector. An annular first splitter wall 142 separates the pilot outer air swirler passage from the intermediate air swirler passage, and an annular second splitter wall 144 separates the intermediate air swirler passage from the mains inner air swirler passage.

The swirling air passing through the passages 120, 124, 130, 134, 140 of the fuel spray nozzle 100 is high pressure and high velocity air derived from the high pressure compressor 14. Each swirler passage 120, 124, 130, 134, 140 has a respective swirler 220, 224, 230, 234, 240 which swirls the air flow through that passage.

Figure 4:
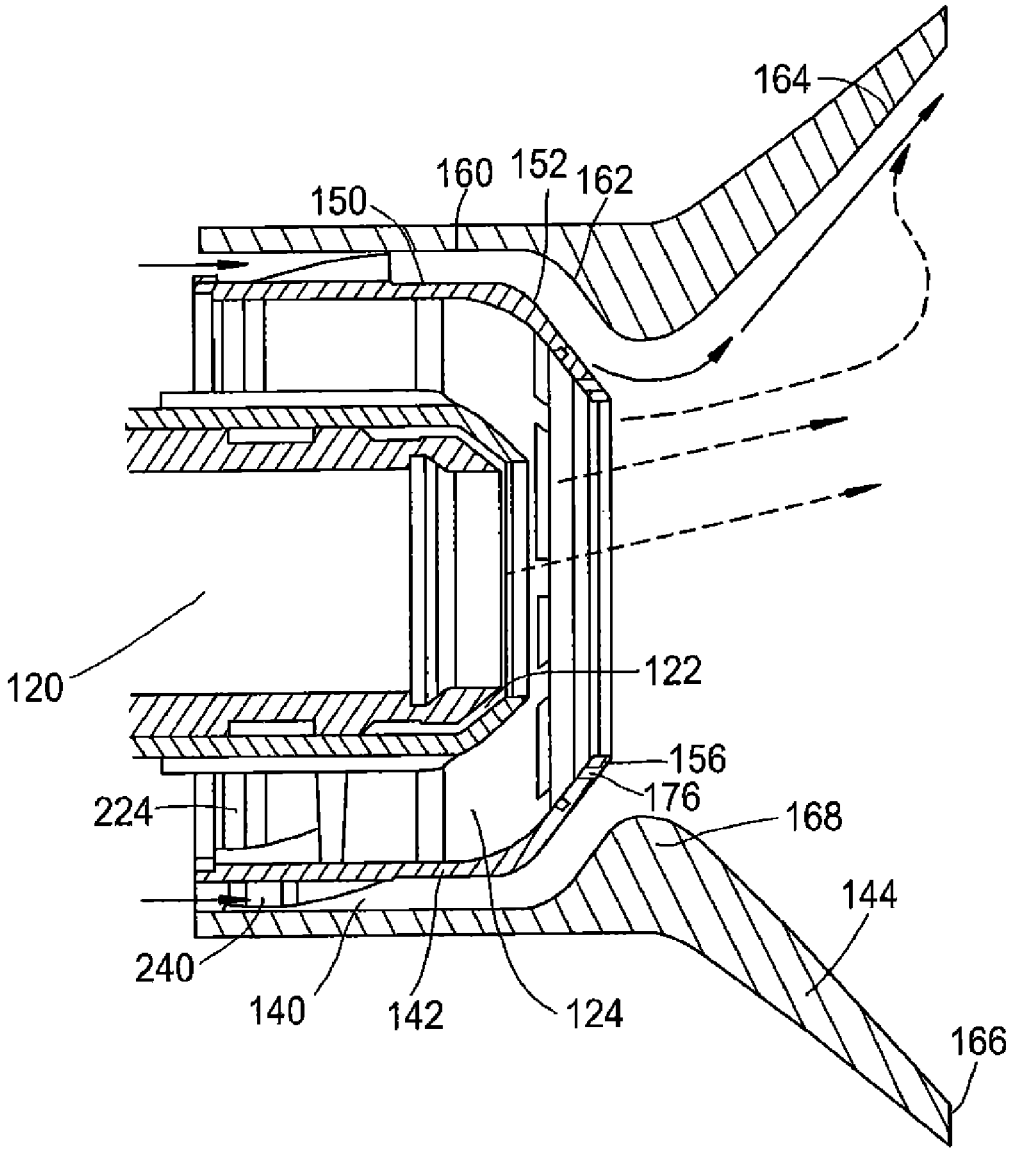
FIG. 4 shows a close-up view of a pilot airblast fuel injector and an intermediate air swirler passage of the fuel spray nozzle of FIG. 3.

FIG. 4 shows a close-up view of the pilot airblast fuel injector and the intermediate air swirler passage 140 of FIG. 3. The first splitter wall 142 has respective an outer surface profile and the second splitter wall 144 has an inner surface profile which respectively define the radially inner and outer sides of the intermediate air swirler passage 140.

The outer surface profile of the first splitter wall 142 has a straight section 150 parallel to the axis of the nozzle followed by a convergent section 152. The inner surface profile of the second splitter wall 144 has a straight section 160 parallel to the axis of the nozzle, followed by a convergent section 162 and then a divergent section 164. The two straight sections 150, 160 define a straight portion of the intermediate passage 140 which contains the swirler 240. The two convergent sections 152, 162 define a convergent portion of the intermediate passage. The first splitter wall is substantially frustoconical over the length of the convergent section 152, which extends downstream to a terminating lip 156 of the first splitter wall. The second splitter wall is substantially frustoconical over the length of the divergent section 164, which extends downstream to a terminating lip 166 of the second splitter wall. The second splitter wall has an inwardly directed annular nose 168 between the convergent 162 and divergent 164 sections.

Air flow through and from the intermediate passage 140 is indicated in FIG. 4 by solid arrowed lines. Air flow from the inner 120 and outer 124 swirler air passages of the pilot airblast fuel injector is indicated in FIG. 4 by dashed arrowed lines. The air flow from the pilot airblast fuel injector tends not to mix with the air flow from the intermediate passage, allowing the air flow from the pilot swirler air passages to produce a beneficial "S"-shaped recirculation pattern.

If the second splitter wall 144 did not have a convergent section 162 and the inwardly directed nose 168, the air flow through the intermediate passage 140 would tend to separate from the first splitter wall 142 as it turned radially outwardly along the frustoconical section of the of the second splitter wall. However, by adopting a convergent-divergent profile for the inner surface of the second splitter wall 144, an increased path length for the air flow through the intermediate passage 140 is produced. In particular, the air flow is forced in the convergent portion of the passage to follow the line of the frustoconical part of the first splitter wall 142. This helps to ensure that the air flow forms a cooling film over the first splitter wall, particularly towards its lip 156. In this way, the metal temperature of exposed parts of the first splitter wall can be reduced, improving the service life of the nozzle.

At the end of the convergent portion of the intermediate passage 140, the air flow then turns around the nose 168, the air forming a cooling film over the frustoconical part of the second splitter wall 144.

To maintain a swirling flow, despite the increased path length for the air flow through the intermediate passage 140, the swirler 240 can produce a relatively high swirl angle, e.g. of more than 45° or preferably of more than 55° or 65°.

In general it is desirable that the air flow from the pilot airblast fuel injector does not to mix with the air flow from the intermediate passage 140. To this end, the second splitter wall 144 can be shaped such that the air flow through the intermediate passage 140 turns around the nose 168 to leave a short portion of the first splitter wall 142 at the terminating lip 156 unwashed by the flow. To avoid overheating at this short portion, the first splitter wall can contain a row of angled effusion holes 176 adjacent its terminating lip which allow some of the air flow through the intermediate passage to effuse through and cool the wall.

Figure 5:
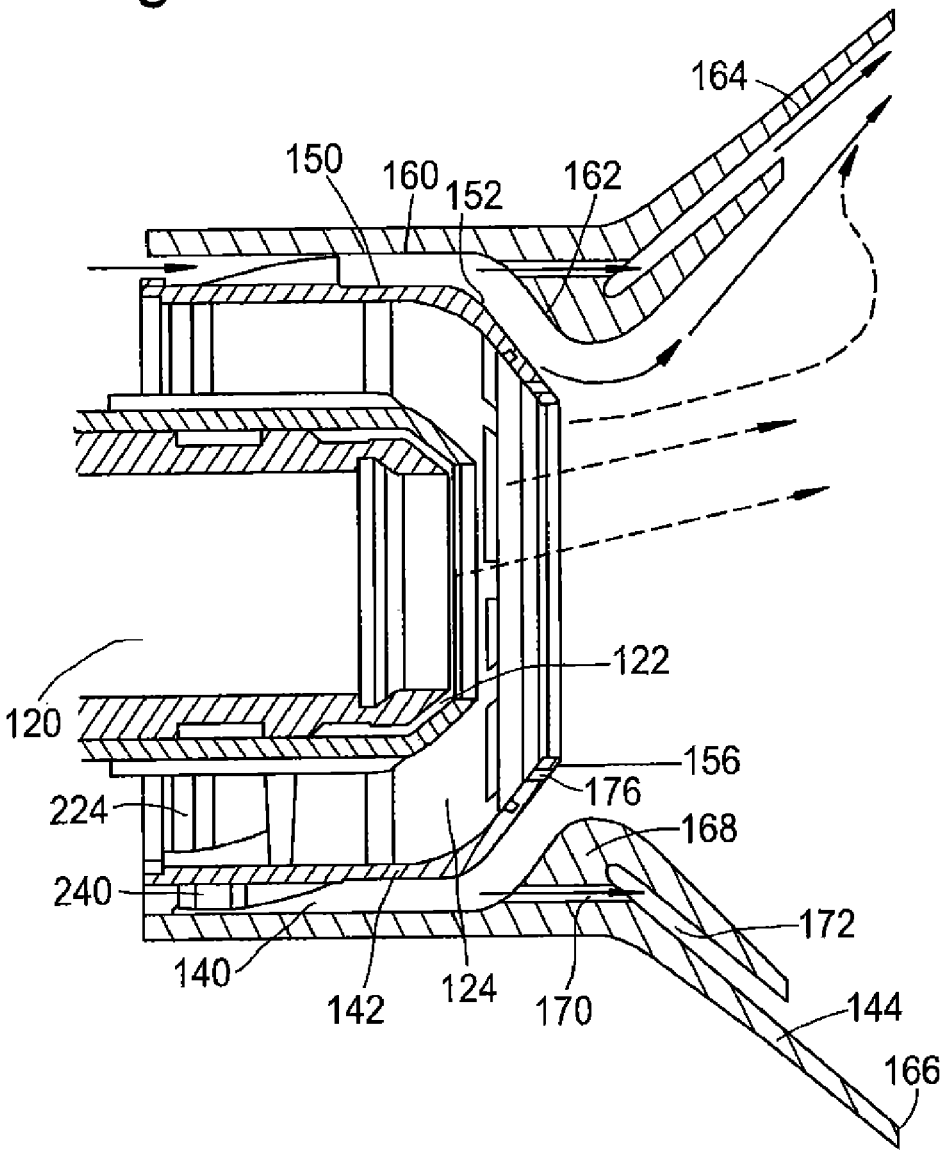
FIG. 5 shows a variant of the fuel spray nozzle of FIG. 3 in another close-up view of the pilot airblast fuel injector and the intermediate air swirler passage.

FIG. 5 shows a variant of the fuel spray nozzle of FIG. 3 in another close-up view of the pilot airblast fuel injector and the intermediate air swirler passage 140. Features of the variant corresponding to features of the nozzle of FIGS. 3 and 4 retain the reference numbers of FIGS. 3 and 4.

The increased length of the flow path for the air flow through the intermediate passage 140 can reduce the effectiveness of the cooling film at the downstream end of the frustoconical part of the second splitter wall 144. To counteract this, in the variant the second splitter wall contains a row of circumferentially arranged internal bypass ducts 170 which run across the nose 168. The frustoconical part of the second splitter wall also contains an internal annular passage 172. The ducts 170, which can be angled at substantially the same angle as the swirl angle of the air flow through the intermediate passage, divert a portion of the air flow from the intermediate passage away from the convergent portion of the passage and direct it into a downstream end of the internal passage 172. From here, the diverted air, still swirling, coalesces into a continuous circumferential film which flows along the internal passage, to exit therefrom part way along the frustoconical part of the second splitter wall and re-join the non-diverted portion of the air flow. The re-joining air flow is thus well-positioned to improve the cooling film of the downstream end of the frustoconical part of the second splitter wall. In addition, the air jets emerging from the ducts can provide impingement cooling of the second splitter wall on the far surface of the internal passage.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

The invention claimed is:

1. A fuel spray nozzle for a gas turbine engine, the fuel spray nozzle comprising:

a coaxial arrangement of an inner pilot airblast fuel injector and an outer mains airblast fuel injector;

an intermediate air swirler passage which is sandwiched between an outer air swirler passage of the inner pilot airblast fuel injector and an inner swirler air passage of the outer mains airblast fuel injector;

an annular first splitter wall which separates the pilot outer air swirler passage from the intermediate air swirler passage, an outer surface profile of the annular first splitter wall defining a radially inner side of the intermediate air swirler passage; and an annular second splitter wall which separates the intermediate air swirler passage from the mains inner air swirler passage, an inner surface profile of the annular second splitter wall defining a radially outer side of the intermediate air swirler passage, wherein the outer surface profile of the annular first splitter wall and the inner surface profile of the annular second splitter wall have respective convergent sections which face each other to produce a convergent portion of the intermediate air swirler passage, the inner surface profile of the annular second splitter wall further has a divergent section downstream of the convergent section of the inner surface profile, the annular second splitter wall contains a row of circumferentially arranged internal bypass ducts which are arranged such that, in use, a portion of the air flow through the intermediate air swirler passage is diverted through the internal bypass ducts to by-pass the convergent portion of the intermediate air swirler passage, the annular second splitter wall contains an inwardly directed annular nose that is disposed between the convergent section of the inner surface profile and the divergent section of the inner surface profile, where the internal bypass ducts run across the inwardly directed annular nose, and the diverted air exits the internal bypass ducts to re-join the non-diverted air flow at the divergent section of the inner surface profile of the annular second splitter wall.

2. The fuel spray nozzle according to claim 1, wherein the convergent section of the outer surface profile extends downstream to a terminating annular lip of the annular first splitter wall.

3. The fuel spray nozzle according to claim 1, wherein the annular first splitter wall is substantially frustoconical in shape over the length of the convergent section of the outer surface profile.

4. The fuel spray nozzle according to claim 1, wherein the divergent section of the inner surface profile extends downstream to a terminating annular lip of the annular second splitter wall.

5. The fuel spray nozzle according to claim 1, wherein the annular second splitter wall is substantially frustoconical in shape over the length of the divergent section of the inner surface profile.

6. The fuel spray nozzle according to claim 1, wherein the annular second splitter wall has an inwardly directed annular nose which forms a transition between the convergent and divergent sections of the inner surface profile of the annular second splitter wall.

7. The fuel spray nozzle according to claim 1, wherein the intermediate air swirler passage contains a swirler that produces a swirl angle for the air flow through the intermediate air swirler passage of more than 45° relative to an overall direction of flow through the intermediate air swirler passage.

8. The fuel spray nozzle according to claim 1, wherein the internal bypass ducts are angled at substantially the same angle as the swirl angle of the air flow through the intermediate air swirler passage.

9. The fuel spray nozzle according to claim 1, wherein the annular first splitter wall contains a row of circumferentially arranged effusion holes at a downstream end of the convergent portion of the intermediate air swirler passage.

10. A combustor of a gas turbine engine having a plurality of fuel spray nozzles according to claim 1.

11. A gas turbine engine having the combustor of claim 10.

* * * * *